US010074896B1

(12) United States Patent
Haiflich et al.

(10) Patent No.: US 10,074,896 B1
(45) Date of Patent: Sep. 11, 2018

(54) RV TELEVISION ANTENNA ADAPTER

(71) Applicants: Van M Haiflich, Wauchula, FL (US); Peggy Haiflich, Wauchula, FL (US)

(72) Inventors: Van M Haiflich, Wauchula, FL (US); Peggy Haiflich, Wauchula, FL (US)

( * ) Notice: Subject to any disclaimer, the term of this patent is extended or adjusted under 35 U.S.C. 154(b) by 0 days.

(21) Appl. No.: 15/904,971

(22) Filed: Feb. 26, 2018

(51) Int. Cl.
*H01Q 1/32* (2006.01)
*H01Q 19/04* (2006.01)

(52) U.S. Cl.
CPC ..... *H01Q 1/3275* (2013.01); *H01Q 19/04* (2013.01)

(58) Field of Classification Search
CPC ..... H01Q 1/3275; H01Q 19/04
See application file for complete search history.

(56) References Cited

U.S. PATENT DOCUMENTS 3,739,387 A * 6/1973 Budrow ..... H01Q 1/08 343/714
5,262,793 A * 11/1993 Sperry ..... H01Q 1/005 343/713
7,358,909 B2 4/2008 Sherwood
9,960,481 B2 * 5/2018 Roberts ..... H01Q 1/325

* cited by examiner

*Primary Examiner* — Dameon E Levi
*Assistant Examiner* — David Lotter
(74) *Attorney, Agent, or Firm* — Jason T. Daniel, Esq.; Daniel Law Offices, P.A.

(57) ABSTRACT

An RV television antenna adaptor device includes a main body having a pair of elongated hollow channels for receiving and engaging a pair of support beams of an RV antenna system, and a curved tubular shaft that is positioned opposite to the pair of channels for engaging the circular-shaped opening of a pole-mountable television antenna.

5 Claims, 4 Drawing Sheets

RV TELEVISION ANTENNA ADAPTER

TECHNICAL FIELD

The present invention relates generally to signal reception devices, and more particularly to an adapter for converting the low profile television mast of a recreational vehicle to receive an HDTV antenna.

BACKGROUND

The statements in this section merely provide background information related to the present disclosure and may not constitute prior art.

Recreational and similar vehicles commonly have televisions and other receivers available for the use and enjoyment of the occupants. With such vehicles, it is important to be able to raise and adjust the antenna for best reception and to lower the antenna for travel. To this end, for several years the industry standard for recreational vehicles and travel trailers is to utilize a low profile television antenna system 1, such as that which is illustrated in Background FIG. 1.

As shown, the standard antenna system 1 includes a signal antenna 2 having a mounting block 3 along one side for engaging a pair of rectangular antenna support beams 4. Hardware 5 is mounted on the roof 6 of the vehicle 7, and allows the antenna to be raised, lowered and rotated (see arrow a) via a control unit that is located within the vehicle. One example of a commercially available antenna system is described in U.S. Pat. No. 5,262,793, to Sperry, the contents of which are incorporated herein by reference.

Owing to the unique forces encountered by such systems, the above described support beams are of paramount importance. For this reason, RV manufacturers have maintained this design, despite the fact that it is incompatible with the circular receivers on virtually every type of modern HDTV antenna. As such, RV owners are not currently able to replace the factory supplied (typically) 25 mile range antennas on their vehicles with modern high definition antennas having ranges over 125-150 miles, without also replacing the rest of the antenna system including the beams and internal control unit.

Accordingly, it would be beneficial to provide an adapter that is capable of mating a circular-based HDTV antenna onto to the structure of an existing RV antenna system without the drawbacks described above.

SUMMARY OF THE INVENTION

The present invention is directed to an RV television antenna adaptor device. One embodiment of the present invention can include a main body having a pair of elongated hollow channels for receiving and engaging a pair of support beams of an RV antenna system. The main body can also include a curved tubular shaft that is positioned opposite to the pair of channels. The shaft can extend upward from the top of the main body and can engage the circular-shaped opening of a pole-mountable television antenna.

The adapter device can include any type of hardware for engaging the support shafts and the replacement antenna in either a permanent or removable manner, and can function to permit movement of the replacement antenna via the original antenna system components.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

As described throughout this document, the term "complementary shape," and "complementary dimension," shall be used to describe a shape and size of a component that is identical to, or substantially identical to the shape and size of another identified component.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material (i.e. Velcro®), magnets, and/or compression fittings such as locking pins, clamps, nut/bolts, tethers (e.g., zip ties), snaps and buttons, for example.

Moreover, the term "permanently secured" shall be used to describe a situation wherein two or more objects are joined together in a manner so as to prevent the same objects from being separated. Several nonlimiting examples include various adhesives such as glue or resin, hardware such as nuts and bolts, and welds, for example.

Figure 1:
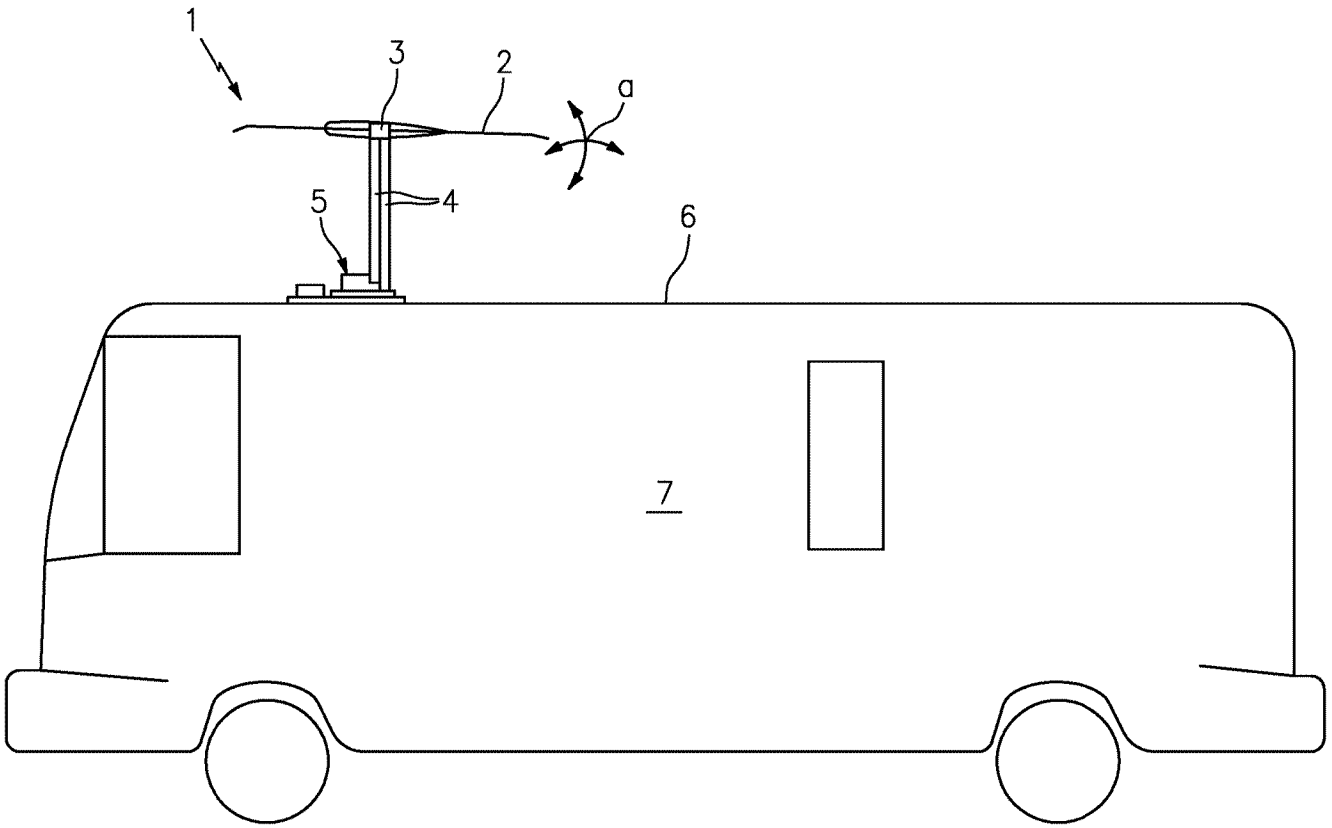
FIG. 1 (BACKGROUND ART)
FIG. 1 is a side view of a low profile RV antenna system, in accordance with background art.
Figure 2:
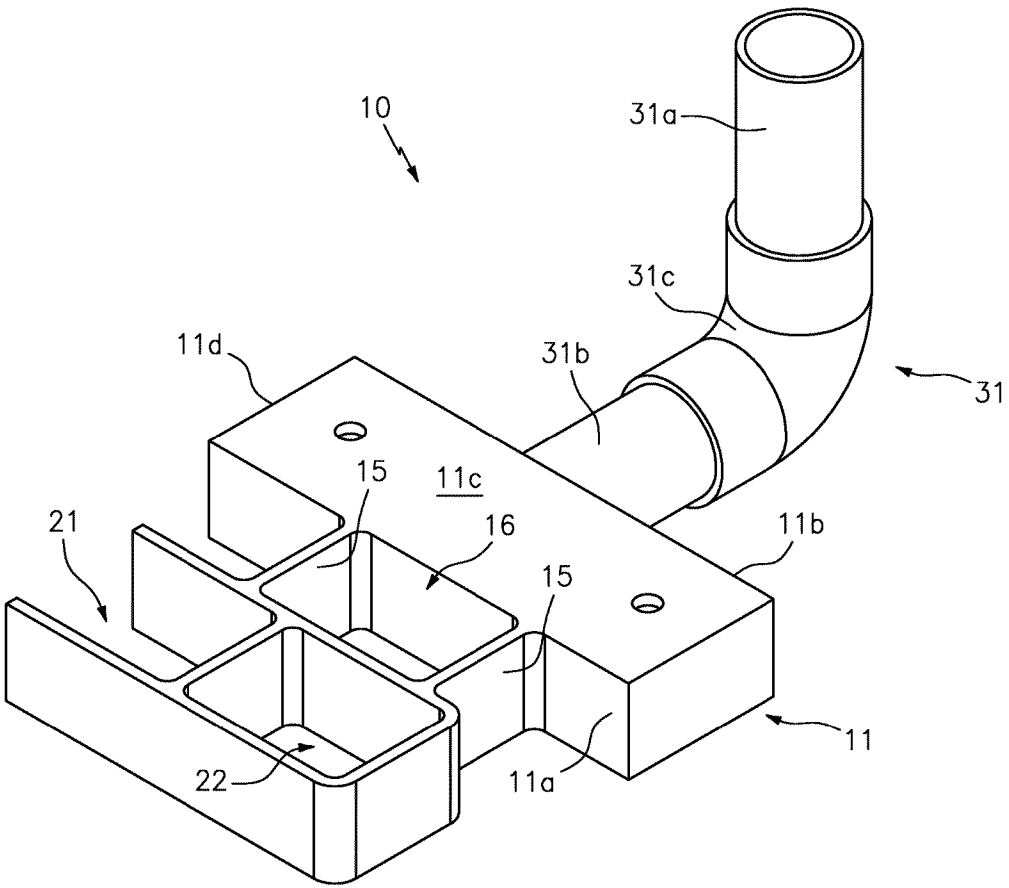
FIG. 2 is a perspective view of the RV television antenna adapter device in accordance with one embodiment of the invention.
Figure 3:
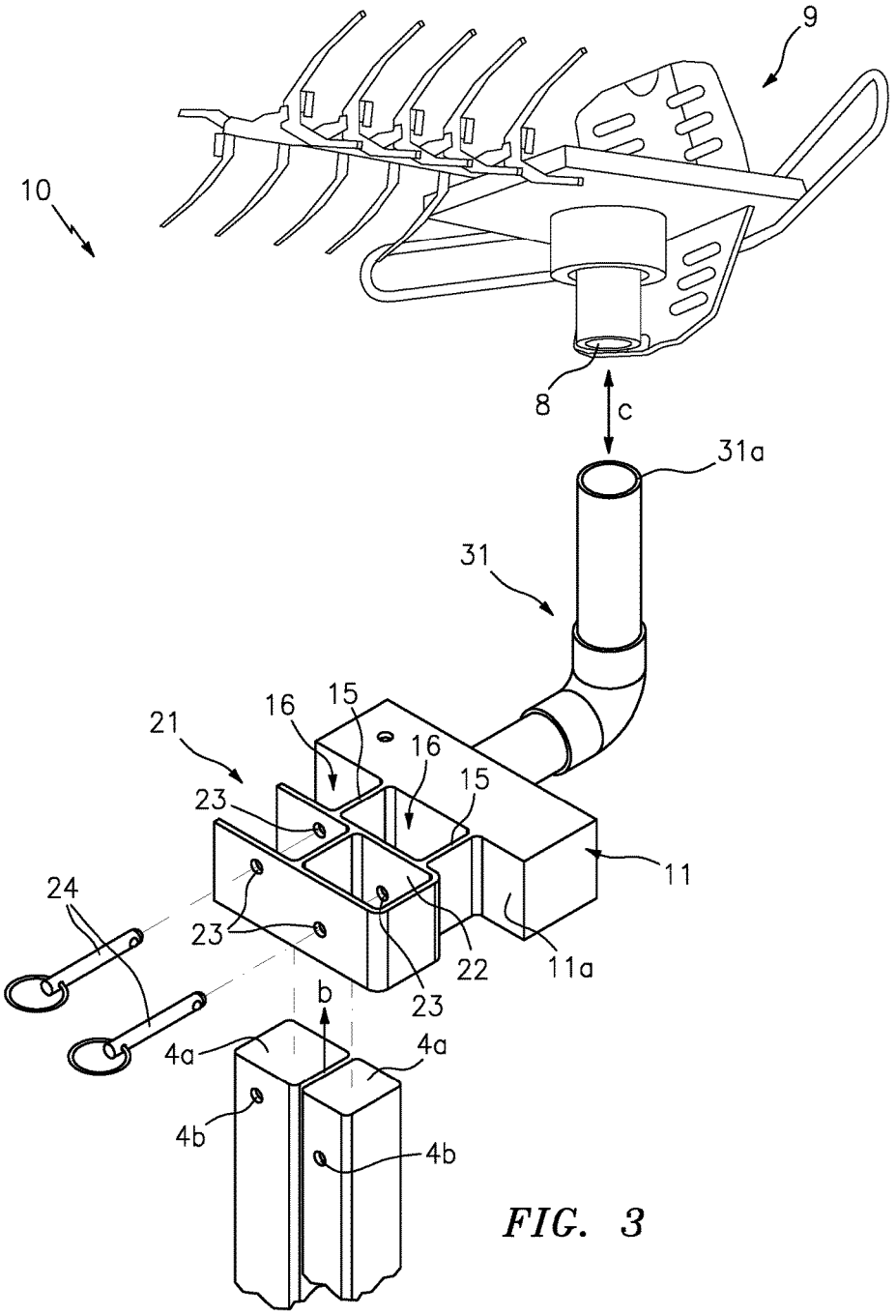
FIG. 3 is a perspective view of the RV television antenna adapter device in operation, and in accordance with one embodiment of the invention.
Figure 4:
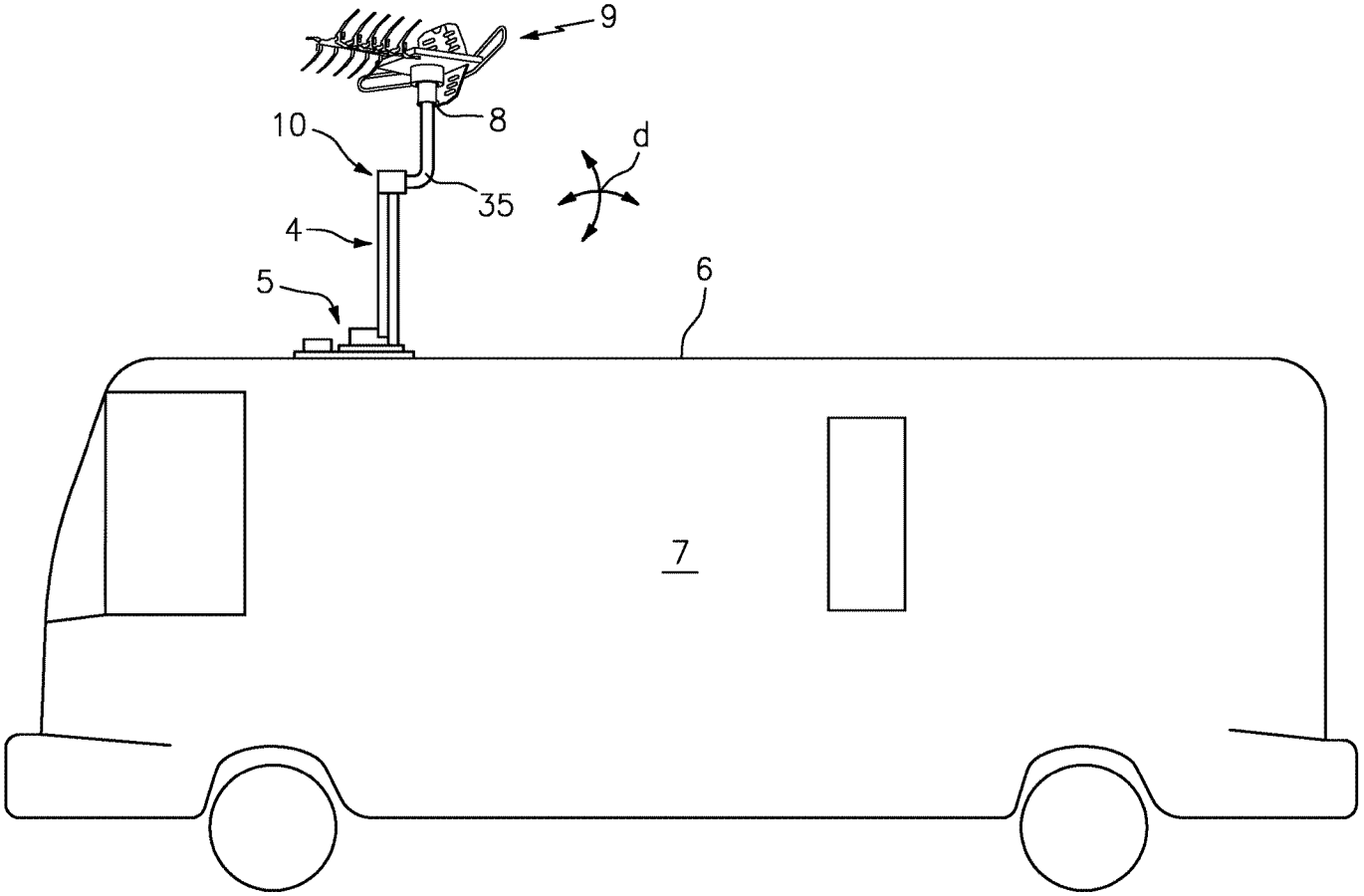
FIG. 4 is a side view the RV television antenna adapter device in operation on the roof of a recreational vehicle, in accordance with one embodiment of the invention.

FIGS. 2-4 illustrate one embodiment of an Recreational Vehicle (RV) television antenna adapter device 10 that is useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom,"

"right," "left," "front," "vertical," "horizontal," and derivatives thereof shall relate to the invention as oriented in FIG. 2.

As shown, the device 10 can include a generally rectangular shaped main body member 11 having a first end 11*a*, a second end 11*b*, a top end 11*c* and a bottom end 11*d*. In the preferred embodiment, the main body 11 will be constructed from a metal or metal alloy, such as aluminum, steel, or alloys thereof. Such materials are extremely well suited for prolonged exposure to adverse weather conditions, and the metallic qualities function to conduct the signal.

Of course, the main body is not limited to any particular construction material as the main body may be formed from any number of different materials that are, for example, relatively strong and stiff for their weight. Several nonlimiting examples also include various plastics/polymers (e.g., high-density polyethylene (HDPE) or polyethylene terephthalate (PET)), and/or various composite materials (e.g., carbon fibers in a polymer matrix, fiberglass, etc.).

As shown, two generally rectangular-shaped hollow channels 21 and 22 can be positioned adjacent to the first end 11*a* of the main body via arms 15. Each of the channels can be oriented parallel to each other, and can comprise vertical shafts (i.e., perpendicular to the major axis of the main body 11) having a shape, size and orientation that is complementary to the shape, size and orientation of the distal ends of the above described support beams 4 of a traditional RV antenna system. Each of the channels can include apertures 23 for receiving locking pins 24 (See FIG. 3).

As shown, an elongated generally tubular-shaped shaft 31 can extend outward from the main body 11. The shaft can include a first end 31*a*, a second end 31*b* that is connected to the second end of the main body 11*b*, and a 90 degree curved middle section 31*c* that is positioned between the first and second ends. In the preferred embodiment, the first end of the shaft 31*a* will have a shape and size that is complementary to the shape and size of the circular-shaped receiver of a pole mounted antenna, so as to be positioned therein.

FIGS. 3-4 illustrate one embodiment of the device 10 in operation. As shown by arrow b, the top ends 4*a* of the support shafts 4 can be positioned within the channels 21 and 22. When so positioned, corresponding apertures 4*b* on each shaft can be aligned with apertures 23 on the channels, and a pair of locking pins 24 can be inserted through the apertures 23 and 4*b*. When so positioned, the distal ends of the locking pins can be located within the gaps 16 defined by the arms 15. Next, the distal end of the shaft 31*a* can be secured within the circular-shaped receiver portion 8 of any type of pole mounted antenna 9, as shown by arrow c.

Accordingly, the above described adapter device 10 allows a user to quickly and easily replace an existing antenna on an RV 7 with any type of pole mounted antenna 8, utilizing the existing support beams 4 and hardware 5, while maintaining the full functionality of the system to be raised, lowered and rotated, as shown by arrow d.

While the dimensions of the elements are not critical, in the preferred embodiment the shaft 31 can include an outside diameter of 0.5 inches, and a height (e.g. vertical separation distance between elements 11*c* and 31*a*) of between approximately 2 and 4 inches. Such dimensions ensures the replacement antenna will be able to rotate 360 degrees without making contact with the main body 11 and/or the support beams 4.

As described herein, one or more elements of the adapter device 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements such as the main body 11, channels 21/22 and/or shaft 31 (including all subcomponents), for example, may be formed together as one continuous element, either through manufacturing processes, such as welding, casting, or molding, or through the use of a singular piece of material milled or machined with the aforementioned components forming identifiable sections thereof. Accordingly, in one embodiment the entire adapter 10 can be formed from a single mold of material such as steel or plastic, for example.

Although described above as utilizing locking pins and the circular-shaped receiver portion of an antenna, this is for illustrative purposes only. To this end, the adapter device can include any number of different types of hardware that is capable of engaging the support shafts and/or the replacement antenna in either a permanent or removable manner.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An adapter device for a recreational vehicle television antenna system, said device comprising:

a main body having a first end, a second end, and a top end;

a pair of channels that are positioned adjacent to the first end of the main body, said channels being oriented perpendicular to a major axis of the main body; and a tubular shaft that extends outward from the second end of the main body, said shaft including a central bend and a distal end, wherein the pair of channels are configured to engage a pair of support shafts of an existing RV antenna system, and the tubular shaft is configured to be secured to a replacement antenna.

2. The device of claim 1, further comprising:

a first and second set of apertures that are disposed within the pair of channels, each of the first and second set of apertures including a shape and location that is configured to align with a corresponding apertures of a pair of support shafts that are positioned within each of the pair of channels.

3. The device of claim 2, further comprising:

a pair of locking pins, each of the locking pins being configured to engage both the apertures and the corresponding apertures of the channels and support shafts.

4. The device of claim 1, wherein the distal end of the tubular shaft includes a shape and size that is complementary to a shape and size of a circular-shaped receiver of the replacement antenna.

5. The device of claim 1, wherein the main body, the pair of channels and the tubular shaft are constructed from metal.

* * * * *